United States Patent [19]

McInerny

[11] Patent Number: 4,500,084

[45] Date of Patent: Feb. 19, 1985

[54] STRIPPER MECHANISM FOR DOCUMENT SEPARATING APPARATUS

[75] Inventor: George P. McInerny, Andalusia, Pa.

[73] Assignee: Technitrol, Inc., Philadelphia, Pa.

[21] Appl. No.: 517,683

[22] Filed: Jul. 27, 1983

[51] Int. Cl.[3] ..... B65H 3/52

[52] U.S. Cl. ..... 271/35; 271/122

[58] Field of Search ..... 271/35, 121, 122, 124, 271/125

[56] References Cited

U.S. PATENT DOCUMENTS 4,216,952 8/1980 McInerny ..... 271/122 X 4,416,449 11/1983 McInerny ..... 271/122

*Primary Examiner*—Richard A. Schacher

*Attorney, Agent, or Firm*—Harding, Earley, Follmer & Frailey

[57] ABSTRACT

A document separation device for separating documents in a stack employs counter-rotating feed drum and friction belt members to strip away and hold back more than a single document trying to pass between them. The structure employs a pair of stripper idlers mounted for free-wheeling rotation adjacent the feed drum. The stripper idlers are constructed and arranged so as to be controlled by the documents passing between them and the adjacent feed drum so as to automatically speed up or slow down when required. The stripper idlers are designed to maintain the proper force against the drum or a document passing therebetween to feed the documents in the desired path through the apparatus and to straighten out severely curled leading edges of the documents to avoid jamming, tearing or skewing of the documents. In addition, the idler strippers serve to fan out the documents to hold them in a desirable condition for ease of separation.

11 Claims, 7 Drawing Figures

STRIPPER MECHANISM FOR DOCUMENT SEPARATING APPARATUS

BACKGROUND OF THE INVENTION

The present invention relates to a mechanism for assuring the separation of adjacent documents, such as sheets, in a stack thereof.

The invention will find particular application in connection with the handling of paper money. However, it is useful in other areas as well. In machines of this type it is necessary initially to separate the documents in the stack from one another so they can be individually counted or otherwise processed. Machines of this type are shown in applicant's prior U.S. Pat. Nos. 4,216,952 and 4,253,615 and in application Ser. No. 205,783 filed Nov. 10, 1980.

The above-mentioned prior art discloses document separating apparatus in which two high friction drums placed side by side are opposed by a counter-rotating resilient friction stripper belt supported between two pulleys one of which is driven. The belt is deflected and stretched taut over a free-wheeling pulley, coaxial with the drums, between the drums and of a slightly smaller diameter. The friction belt is driven in opposition to the friction drums which pull the document closest the drum along the document path. Such a structure works very well in connection with new money or with money in most conditions of use, as well as with stiffer documents of all sorts. However, some documents become so limp that they develop a cloth-like texture and tend to conform closely to the shape of the surfaces by which they are contacted in the device. Currency or other documents which are limp tend to have a special problem relative to a tendency to curl and develop small tears along their edges. Additionally, the taut friction stripping belt used in the past tends to cause edges of limp bills to curl and the bills to skew as it forces the bills into conformance with the idler pulley between the friction drums. Skewing, in turn, can cause bills to partially overlap and produce errors in counting as well as resulting in problems in stacking.

In an effort to accommodate to the different conditions of currency, an adjustment has been provided on machines in the past which allows the stripping friction belt to be held taut when processing new currency or other types of firm documents and to be slackened somewhat when worn currency is introduced. However, the touch required to handle these extremes has proven somewhat critical and the required adjustment has not been made successfully in some instances, without taking great pains causing problems for the users of the various machines.

In application Ser. No. 328,951, filed Dec. 9, 1981, there is disclosed a document separating apparatus of the above-described type capable of separating new currency without adjustment or at least with only minor adjustment which is much less critical than adjustments which have had to be made in the past. This apparatus employs a slack friction belt and interposes between the belt supporting pulleys a third idler pulley opposite the region where the belt wraps around the free-wheeling pulley between the friction drums. Opposition diameters of the third pulley are preferably just bearly out of contact with the belt when no documents are passing through. The third pulley is movably mounted so it can change position and has rim portions which contact respective friction drums. In use, because of the force of the friction belt on it, limp money conforms to an idler pulley between the friction drum members and displaces the third pulley only the thickness of the money. As stiff currency passes through, however, the belt itself is lifted out of the groove and away from the belt deflecting idler pulley. Lifting the friction belt causes the belt to engage the third pulley which also displaces the third pulley toward the part of the belt at its opposite diameter. Thus, this action causes the belt to tension at that opposite side as well as at the place it is displaced by the money, and thereby even further increasing the tension which improves the stripping effect on the stiffer bills as they pass through. At such times the rim portions of the pulley are capable of being lifted out of contact of the stiffer money. However, when the currency is limp, the rim portions of the third pulley that would ordinarily rest on the friction drum surfaces now rest on part of the limp paper money on the side thereof opposite the friction drum surfaces and effectively act as guides to stabilize and provide equal forces to each drive to further help in preventing skewing of the money as it passes through.

While the above-described devices are capable of processing a wide range of new and used paper currency, they can jam when they encounter a sheet having a severely curled leading edge. The badly curled edge tends to push the sheet backwardly toward the stack and the sheet never enters the nip between the drum and the belt where the feeding action occurs.

A common problem with all friction type feeding devices including those of the above-described type is that the stripping means usually has a friction coefficient of about one half that of the feed means. When a document enters the feeding area, i.e., the nip between a feed roller and a fixed or counter-rotating stripper, the higher friction feed roller conveys the bottom document through the apparatus while the succeeding document is held back. Because the friction means is a stripper device, under some conditions it is difficult to get the document into the feeding area far enough to be driven by the feed means. This is particularly difficult when documents have curled or torn edges, such as found on some circulated currency. In the prior art devices, as shown in FIG. 7 of the drawings, a spring loaded device is used to urge the documents with a light force into the nip of the feed stripper means. Typically such devices comprise a flat spring or a spring loaded ball bearing contacting the feed roller just prior to the stripping means. A critical adjustment of the spring device is usually required because an excessive force between the spring device and the feedroll will tend to lock the documents together (a condition referred to in the art as "fiber lock") making them difficult to separate. Moreover, these low friction devices usually will not straighten out curled leading edges whereby jamming, tearing and skewing of the documents can result.

SUMMARY OF THE INVENTION

The present invention constitutes an improvement over the document separating apparatus described in said application Ser. No. 328,951 so that the apparatus can separate all types of documents including even those documents having severely curled leading edges. To this end, the present invention comprises a pair of stripper idlers mounted for free-wheeling rotation on the axis of the drive pulley for the friction stripper belt. The stripper idlers have a circular rim having a radius such that the rim contacts the peripheral surface of the feed roller when no document is present in the feeding area between the feed roller and the opposed portions of the rotating stripper belt whereby the stripper idlers are caused to rotate with the rotating feed roller at the same surface speed thereof. The geometry of the stripper idlers is such that the circular rims of each is flexible away from the feed roller when a document is present in the feeding area and to apply the proper force thereto. This force is heavy enough to create friction between the bottom document and the feed roller to cause the bottom document in the stack to be fed in the desired direction of travel through the apparatus and at the same time light enough so as not to create an excessive force that tends to lock the bottom document by friction (i.e., "fiber lock") to the succeeding document in contact therewith and immediately thereabove in the stack. The stripper idlers are constructed and arranged so that when a sheet having a severely curled edge comes into the feeding entry position, the stripper idlers pull the curled edge downward to a straightened condition to allow it to get into the feeding area between the feed roller and the stripper belt. Once this occurs, the feed roller which has a higher friction than the stripper belt, will override the stripping action of the stripper belt so that the bottom document is separated from the stack and fed through the apparatus.

In the use of the apparatus of the invention, a stack of documents is placed in an input hopper with the bottom document being driven towards the stripper idlers by a hopper conveyer belt. The bottom document is urged into the nip of the feed roller and the counter-rotating stripper belt. When a document passes between the stripper idler and the feed roller, the high friction drive between the two is greatly reduced by the document, and the stripper idlers will slow down to approximately the speed of the documents receding in the hopper tray. This is due to the friction of the leading edges of the documents bearing against the circumference of the stripper idlers. This slow rotation will continue as long as the documents are feeding in the normal manner edge-to-edge through the apparatus. This slow rotation tends to guide the curled edges into the feed stripper means. However, should a document having a severely curled leading edge move into the feed entry position and fail to enter under the stripper idlers, the continuous edge-to-edge flow of documents is interrupted and the high friction forces of the stripper idlers and the feed roller come into contact causing a speed up of the stripper idlers to the surface speed of the feed roller. When this occurs, the friction surface of the rotating stripper idlers will straighten the curl and pull the document into the feed area.

The stripper mechanism in accordance with the invention performs several advantageous functions in the document separating apparatus. Firstly, as described above, the stripper idlers bend or curl down the front edge of any severely curled document so that it can be fed into the feeding area. In addition, the stripper idlers serve to fan out the documents in the stack to conform the stack to a shape which is very desirable for the ease of separation of the bottom document. In addition, the necessity for a critical adjustment of the stripper apparatus is eliminated because the stripper idlers by reason of their design maintain the proper force against the feed rollers required at the entry location.

DESCRIPTION OF THE PREFERRED EMBODIMENT OF THE PRESENT INVENTION

Figure 1:
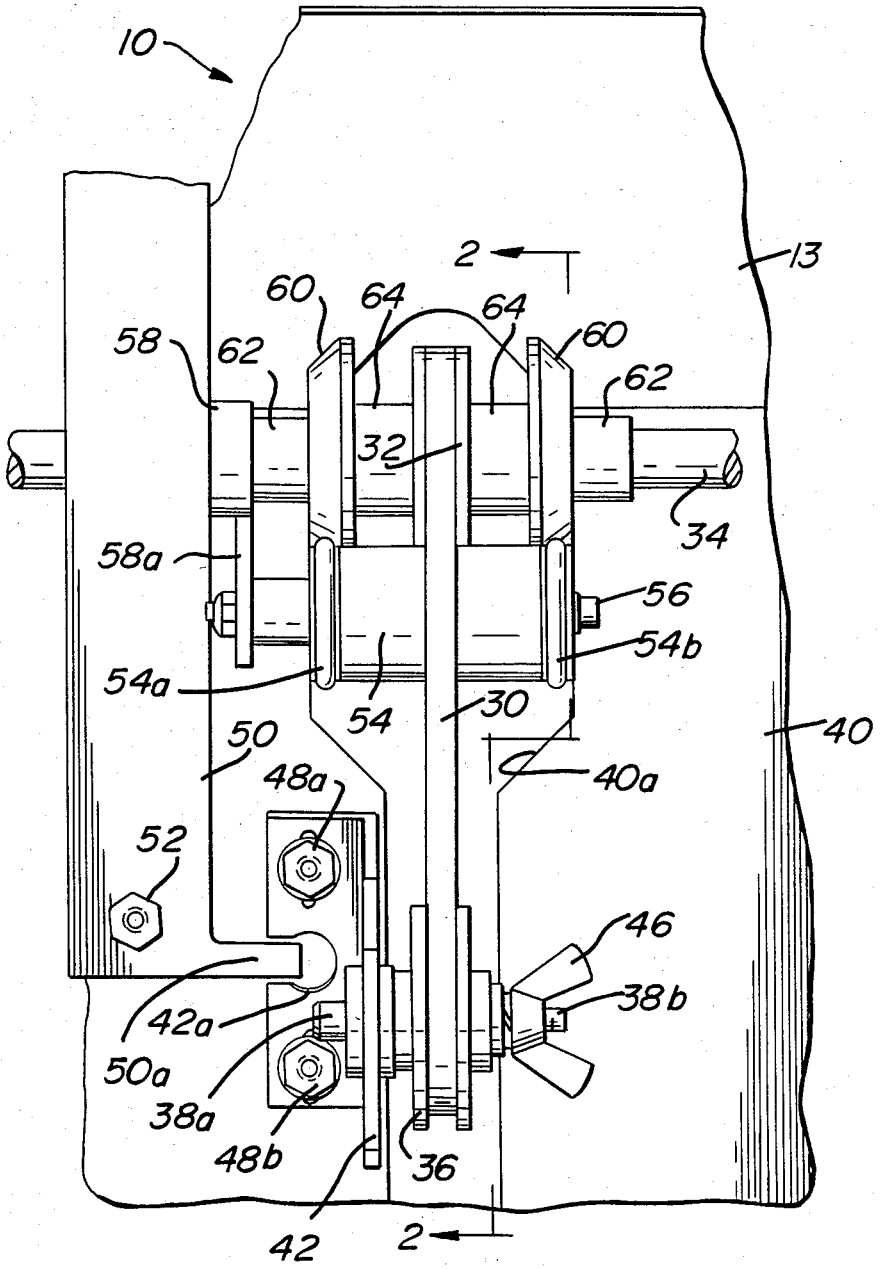
FIG. 1 is a fragmentary view of the stripper mechanism in accordance with the invention as viewed from the back of a machine employing such a stripper mechanism.
Figure 2:
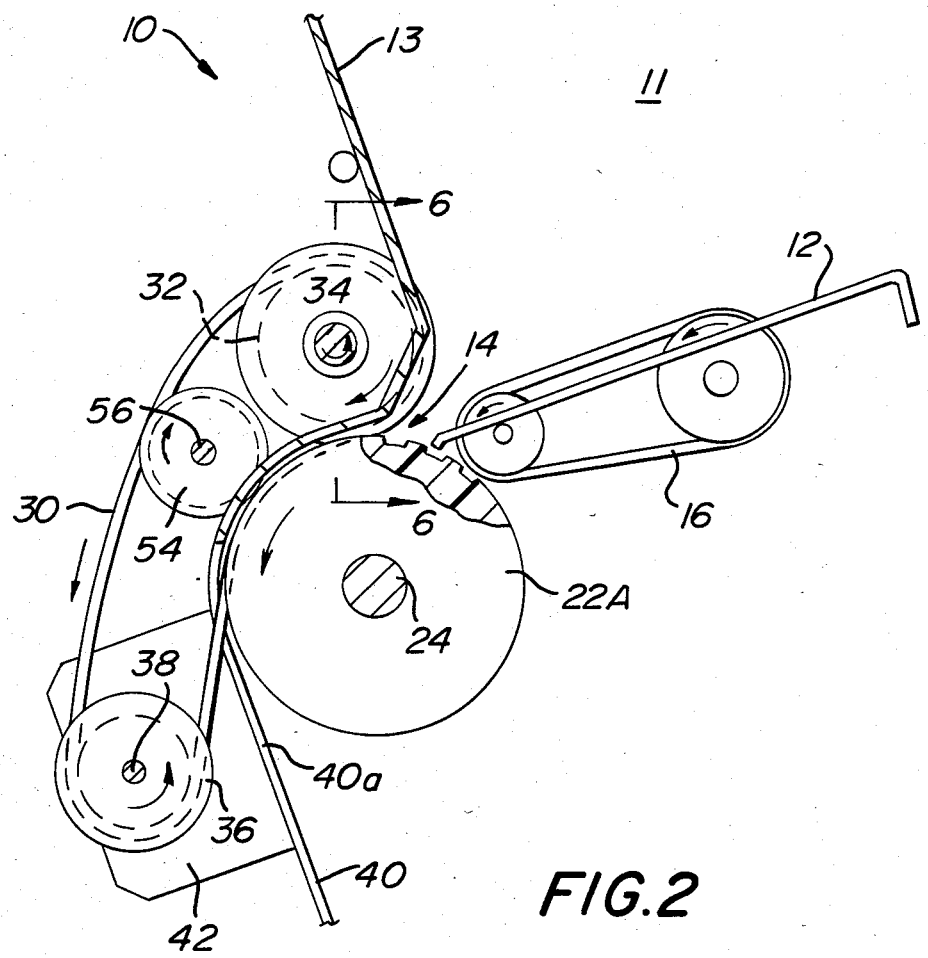
FIG. 2 is a sectional view taken on lines 2—2 of FIG. 1.

Referring to FIGS. 1 and 2, a document processing machine is generally represented at 10 and has a housing and a frame which includes the sidewalls of the housing. The housing provides a document input bin 11 for a stack of documents to supply the machine. Documents are supported upon a shelf 12 and rest against a plate providing a back plane 13 which constitutes a portion of the structure. When a stack of documents is placed on the shelf 12 of the input bin 11, the bottom most document is fed through the opening 14 into the nip of the device of the present invention by a hopper conveyor belt 16 and thereafter is processed through the machine. The stripper mechanism of the invention prevents more than one document from passing through at a time and maintains a continuous feed of all types of documents.

As described in the above-mentioned prior art, specific processing operations to be performed on the documents are controlled by a keyboard and pushbuttons located on the front panel of the document processing machine. After the processing operation is completed, the documents are discharged from the machine onto a collection tray.

The document separating device comprises a shaft 24 which supports a pair of friction drums or rolls 22A and 22B forming the feed roller means. Shaft 24 is mounted on the frame of the machine to be driven about its axis of rotation. The friction drums 22A and 22B are fixed to the shaft to rotate together and have high friction tread portions formed at their end portions adjacent to an idler pulley 26 therebetween with the treads being evenly spaced and parallel to the drum axis and the treads of one drum being offset from those of the other. The drums are separated from each other by a space along the shaft 24 which is occupied by the free-wheeling idler pulley 26, the so-called non-friction belt deflection member, which is supported on the shaft by an oil impregnated bronze bearing 28. The support structure and other features are not illustrated because they have been shown in other applications and patents, particularly U.S. patent application Ser. No. 205,783.

The stripping friction belt 30 is preferably of a resilient stretchable deformable material such as rubber and may be provided with varying types of cross-section depending upon particular application. A preferred cross-section is rectangular to avoid conforming to the shape of the face of idler pulley 26 and minimize forces acting on a paper or bill opposing the drums on the drum side of the documents. The friction belt 30 is shown supported at one end on a drive pulley 32 having a rubber friction surface at its outer periphery. Pulley 32 is mounted on a drive shaft 34 rotatably supported on the sidewalls of the frame for rotation about its longitudinal axis which is parallel to and spaced from the rotational axis of drums 22A and 22B. The pulley 32 is fixed to the drive shaft 34 which is driven by drive means (not shown) and which, in turn, drives the friction belt 30. Shafts 24 and 34 are driven by the drive means in opposite directions to provide the counter-rotating movement of drums 22A and 22B and belt 30, the parts moving in the direction shown by the arrows in FIGS. 2–4.

Friction belt 30 is supported at its other end by an idler pulley 36 which is supported on a shaft 38. In practice each of the pulleys 32 and 36 have flanges such as shown on pulley 36 but these are omitted in some views for the sake of clarity. Both pulleys 32 and 36 are supported on the frame and in this particular case are supported from a back plane 40 of heavy aluminum sheet material which is slotted at 40*a* to permit passage of the belt 30 and support structure where necessary. Backplane 40 is terminated at its upper end at the bin wall 13. The support for shaft 38 is a bracket 42. It will be understood that suitable supports for all of the structure of this general type has been provided in practice and is well understood in the art.

The actual supporting structure of shaft 38 is shown in FIG. 1 which shows the supporting structure for the friction belt 30 viewed from the backside of the machine. FIG. 1 also shows the slotting 40*a* of backplane 40 in order to permit the passage of the belt in its supporting structure. As seen in FIG. 1, pulley 36 is supported on shaft 38 by a variety of pieces described in detail in said application Ser. No. 328,951, the shaft 38 being provided with a head 38*a* and a threaded end shank 38*b*. In the prior art, this kind of structure was highly desirable in order to slacken the belt 30 for flexible documents or to tighten the belt for stiffer ones depending upon different applications in which the device was used. A slot in a bracket 42 runs generally in the direction of extension of the belt 30 to enable the pulley 36 to be moved up or down. Adjustment is made by loosening a wing nut 46 setting the pulley shaft 38 and holding it in place when wing nut 46 is tightened. With the design of application Ser. No. 320,951, such adjustment is still of some convenience but of much less importance and once made it may be generally left without adjustment over long periods of use.

Supporting bracket 42 is a part of an angular bracket the base portion of which is supported on the backplane 40 by suitable fasteners 48*a* and 48*b* which preferably employ spring washers, such as bell washers, to enable the device to be moved under a leverage force. This kind of movement permits a fine tensioning adjustment of the belt. Adjustment of the bracket along these slots is accomplished by use of a lever 50 which moves about a pivot 52 attaching the lever 50 to the backplane 40. Attached to lever 50 is a crank arm 50*a* which engages the sidewalls of a rounded slot 42*a* to move the supporting bracket 42 up and down as desired.

Another pulley 54, the so-called third rotatable means, is rotatably supported on a shaft 56 for rotatable movement in a free-wheeling way. The pulley 54 can conveniently be made of moldable plastic material such as "Delrin". Pulley 54 is provided with enlarged diameter rim portions 54*a* and 54*b* which are spaced apart sufficiently to give a wide clearance for the belt 30 and so that each rides on a smooth portion of the surface of the friction drums 22A and 22B, respectively. The pulley diameter preferably is such as to not contact but remain spaced from the belt 30 in the slack belt condition when no document is passing through the apparatus. Otherwise stated, the pulley 54 preferably does not apply tension to the belt 30 in the position where there is no paper passing through the nip of the belt 30 and the friction drums 22A and 22B.

Shaft 56 of the pulley 54 is supported on an arm 58*a* of bracket 58 which, in turn, is pivotally supported on shaft 34. The support structure is of such length as to position the pulley 54 in the vicinity of the mid point of the wrap around of the friction belt 30 on the pulley 26 intermediate the drums 22A and 22B. The arm 58*a* is movable so that the rim portions 54*a* and 54*b* can move into contact with the friction surfaces of the drums 22A and 22B, respectively, but is designed to permit the idler pulley 54 to move away from the drums as paper passes through. The pulley 54 is of such a diameter that it contacts the friction belt 30 at its outside, remote from the friction drums only slightly, if at all, in the slack condition of the belt when no documents are passing through. Some variation in this is permissible but the optimum would be to have no tension applied in the condition where no documents are passing between the belt and the drum.

Figure 3:
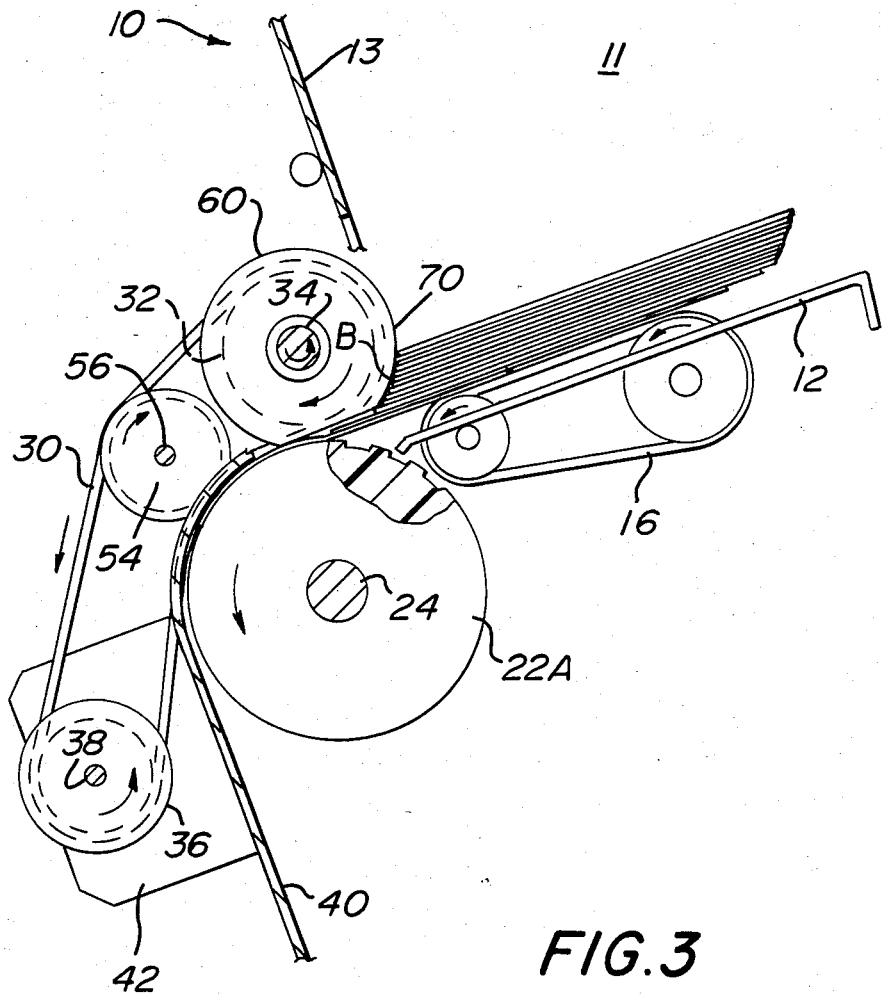
FIG. 3 is a sectional view similar to FIG. 2 with documents beginning to pass through the feed area.
Figure 5:
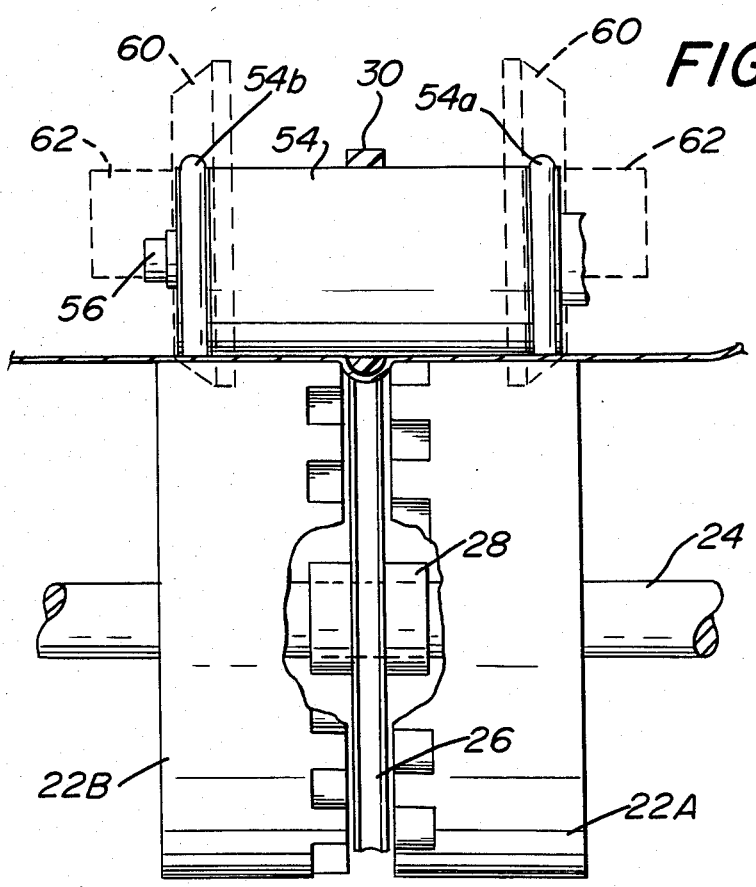
FIG. 5 is a view looking into the nip of the friction drum and the stripper belt of FIG. 2 with the belt in section and viewing the apparatus from the front of the machine.
Figure 7:
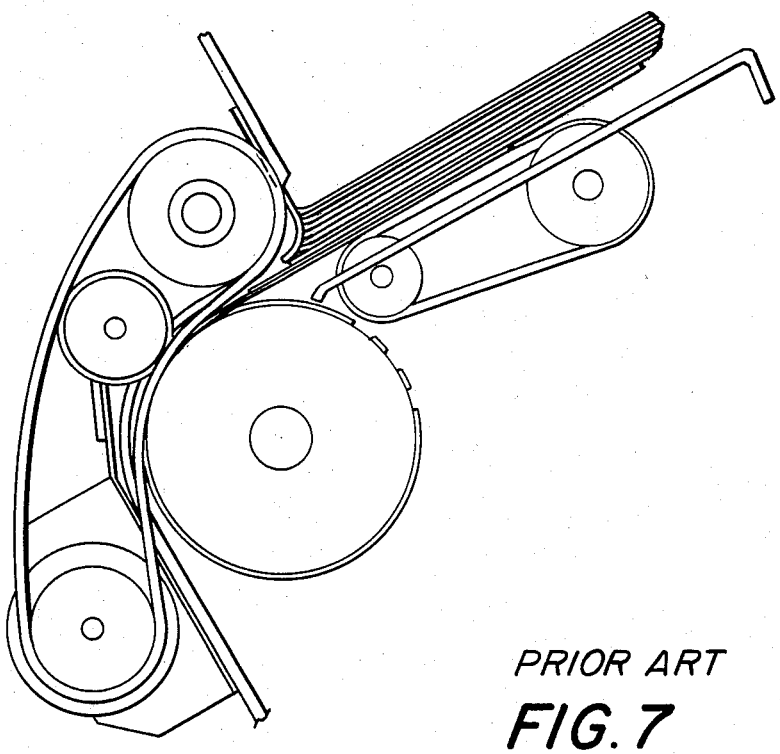
PRIOR ART FIG. 7
FIG. 7 is a view similar to FIG. 4 and showing a prior art arrangement.

FIG. 3 shows the paper within the nip between the belt 30 and friction drums 22A and 22B. In FIG. 5 the paper illustrated is intended to represent thin highly flexible paper such as old worn out bills. Under such circumstances, the belt 30 tends to pull the bill tightly against the low friction surface of free-wheeling pulley 26. FIG. 3 on the other hand is intended to represent the situation where a bill or paper is more or less firm and unyielding as in the case of new currency or computer cards. In such case, the belt is lifted completely off of the pulley 26 and is therefore stretched and caused to tighten more. At the same time, the pulley 54 is moved outwardly against the belt 30 and stretches the outer portion thereof as well, producing further tension in the belt 30 at that point. Thus, a double tensioning effect is achieved causing the stripping effect acting to separate documents to be increased. This action of pulley 54 to change the tension of belt 30 automaticaly to handle highly flexible documents, such as old worn out bills, and firm, unyielding documents, such as new bills or computer cards, is described in detail in said application Ser. No. 328,951.

The stripper mechanism of the present invention comprises a pair of stripper idlers 60 each of which is mounted for free-wheeling rotation on stripper shaft 34 by means of a centrally located journal 62 thereof. Idler pulley 32 for stripper belt 30 is located centrally between stripper idlers 60 which are spaced axially therefrom by spacers 64 as is shown in FIG. 1.

Figure 6:
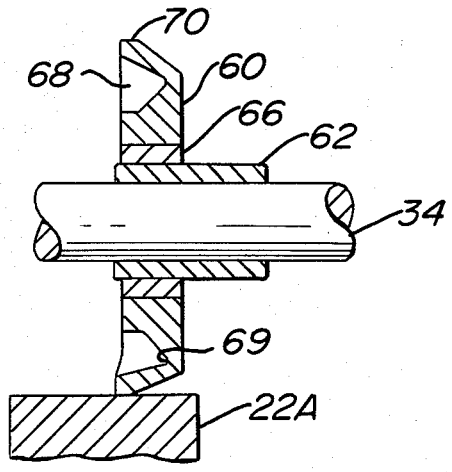
FIG. 6 is a sectional view taken on lines 6—6 of FIG. 2 and showing the stripper idler in detail.

Stripper idlers 60 are identical in construction but are mounted on shaft 34 to face in opposite direction as shown in FIG. 1. As shown in FIG. 6, each stripper idler 60 has a tubular hub 66 which is secured onto journal 64 with a pressed fit. The stripper idlers 60 are made of a high friction elastomer, such as urethane, and have a generally shallow cup-shaped configuration. The geometry of each stripper idler 60 is such that the resiliency thereof will maintain the proper force or pressure against the feed roller means provided by drums 22A and 22B or a document positioned between the stripper idlers and the drums to achieve the document stripping and feeding action as described above. To this end, each stripper idler 60 has an annular cavity 68 which has a generally trough shape in cross-section with a V-shaped bottom terminating in an apex 69. This provides each stripper idler 60 with a thin circular rim 70 which is highly flexible. As is shown in FIGS. 2 and 6, the spacing of shafts 24 and 34 and the radius of rim 70 is such as to cause an interference fit between the rim 70 and the drums 22A and 22B. The cavity 68 is formed to define a wall thickness for rim 70 which permits the rim 70 to deflect about the apex 72 of cavity 68 to provide the desired pressure against either drums 22A and 22B (see the small deflection in FIG. 2) or documents passing therebetween (see the larger deflection in FIGS. 3 and 4).

The stripper idlers 60 are constructed and arranged to assist in the separation of documents from a stack in bin 11 and to assure the separating of adjacent bottom documents in the feeding area. When no documents are present between the stripper idlers 60 and drums 22A and 22B (FIGS. 2 and 6), the stripper idlers 60 are driven by the drums 22A and 22B to rotate on the stripper shaft 34 in a free-wheeling manner at the same surface speed as the drums 22A and 22B. The drums 22A and 22B and the stripper belt 30 are driven in the counter-rotating manner as shown by the arrows in FIG. 3 and 4 and as is described in more detail in said prior application Ser. No. 328,951. When a stack of documents are placed in the bin 11, as shown in FIG. 3, they are driven towards the stripper idlers 60 by the conveyor belt 16. The bottom document in the stack is urged into the nip of the drums 22A and 22B and the counter-rotating stripper belt 30. When a document passes between the stripper idlers 60 and the drums 22A and 22B, the high friction drive therebetween is greatly reduced by the document. The drums 22A and 22B have a higher friction coefficient than stripper idlers 60 and operate to feed the bottom documents through the feeding area. In the arrangement in accordance with the invention, the stripper idlers 60 will slow down to approximately the speed of the documents receding in the hopper tray as the bottom document is fed through the apparatus by drums 22A and 22B. This result is because of the friction of the leading edges of the documents bearing against the rims 70 of the stripper idlers 60 along the surface as indicated at "B" in FIG. 3. This slow rotation of stripper idlers 60 will continue as long as the documents are feeding edge-to-edge in the normal manner. It is noted that this slow rotation serves to guide curled edges into the stripper means.

Figure 4:
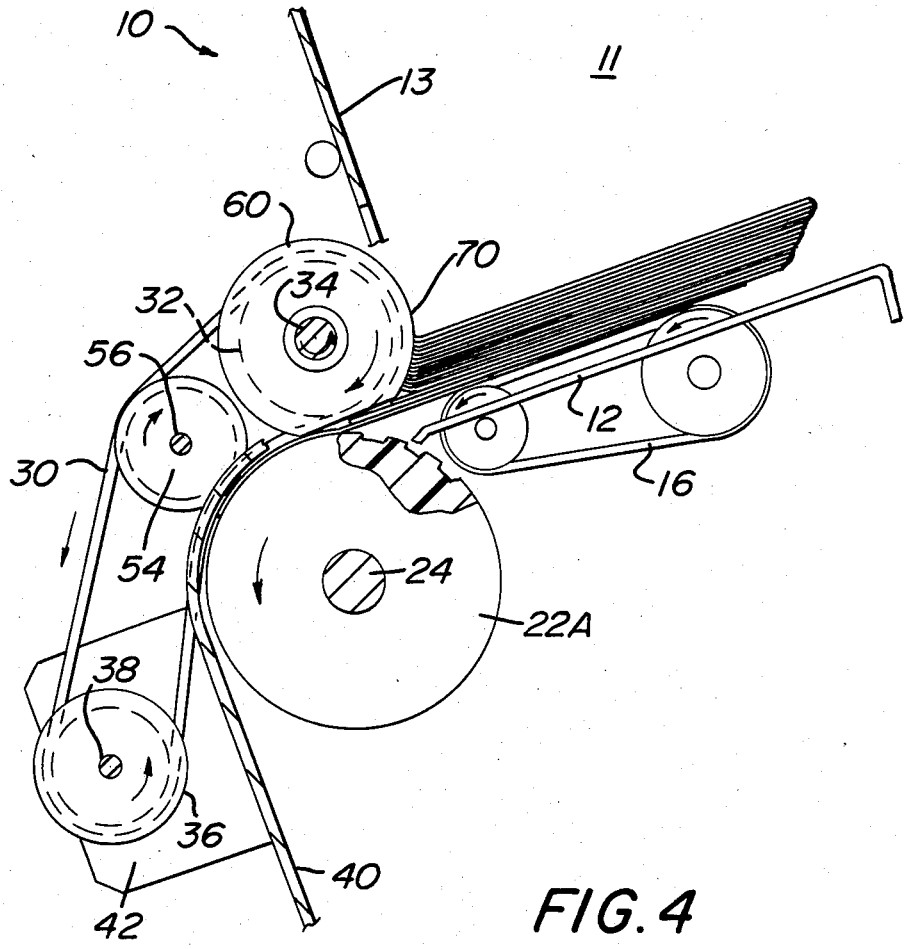
FIG. 4 is a sectional view similar to FIG. 2 with documents having curled front edges about to enter the feed area.

In the event that a document having a severely curled leading edge is present in the stack, such as is shown in FIG. 4, there is a tendency for this document to be restrained against feeding and fail to enter under the cup strippers 60 initially. When this occurs, the continuous edge-to-edge flow of documents becomes interrupted and the high friction surfaces of the stripper idlers 60 and the drums 22A and 22B come into contact thereby causing a speeding up of the stripper idlers 60 to the high surface speed of the drums 22A and 22B. By reason of this speeding up, the friction surface of stripper idler 60 causes the curled front edge of the document to straighten and the document is pulled into the feed path and the normal feeding action will resume.

FIG. 3 illustrates the feature of the invention whereby the stripper idlers 60 fan out the documents so as to provide a very desirable condition for the ease of separation of the documents. Moreover, it is noted that by reason of the design of the stripper idlers 60 providing the appropriate geometry and material resiliency, there is no critical adjustment necessary to provide the proper force or pressure against the drums 22A and 22B to achieve both the feeding of the bottom document and the avoidance of any "fiber lock" between adjacent documents as discussed in detail above.

While a preferred embodiment of the invention has been shown and described, it will be apparent that others will occur to those skilled in the art. All such modifications, changes and other embodiments of the invention within the scope of the claims are intended to be within the scope and spirit of the present invention.

What is claimed is:

1. A document separating apparatus for separating documents such as sheets or the like from a stack thereof comprising:

a frame, a feed roller means mounted for rotation with a first rotating drive shaft mounted on said frame, a stripper means mounted on said frame in opposed relation to said feed roller means for counter-rotation to said rotation of said feed roller means, a bin for holding a stack of documents, said feed roller means and stripper means being mounted adjacent the bottom end of the stack of documents in said bin for receiving documents fed from the bottom of said stack into a document feeding area where said feed roller means moves in the direction of feed of the documents through the apparatus and said stripper means moves counter to said direction of document feed for stripping all but the bottom document entering the document feeding area, and a pair of stripper idlers mounted for free-wheeling rotation on a second shaft and located in said document feeding area with said stripper means therebetween, each of said stripper idlers having a circular rim constructed and arranged to contact the surface of said feed roller means in said document feeding area with an interference fit so that when no document is present between said feed roller means and said stripper idlers, said stripper idlers are caused to rotate with said feed roller means in the direction of movement of documents through the apparatus, said circular rims of said stripper idlers being flexible away from said feed roller means and being constructed and arranged such that when documents are present between said stripper idlers and said feed roller means, a desired pressure is applied to said documents that allows the bottom document to be fed in the desired direction through the apparatus by said feed roller means without creating an excessive force which tends to lock the bottom document by friction to the document thereabove.

2. A document separating apparatus according to claim 1 wherein said circular rim of each of said stripper idlers is defined by an annular cavity in the side of said stripper idlers facing the stripper means therebetween.

3. A document separating apparatus according to claim 2 wherein each of said cavities and has a generally trough-shaped cross-section such that the circular rim tends to flex about the deepest point of said cavity.

4. A document separting apparatus according to claim 3 wherein said cavity is of a configuration to form a relatively thin circular rim which is highly flexible to apply said desired pressure to the documents as they are fed through the document feeding area.

5. A document separating apparatus according to claim 4 wherein said stripper means comprises a stripper friction belt passing around a drive pulley mounted on said second shaft adjacent the bottom area of said stack of documents, said second shaft being driven in the opposite direction to said first shaft, said stripper idlers being rotatably mounted on said second shaft for free-wheeling rotation.

6. A document separating apparatus according to claim 4 wherein each of said stripper idlers has a generally shallow cup-shaped configuration having a tubular base secured to a journal bearing mounted on said second shaft.

7. A document separating apparatus according to claim 4 wherein the bottom of said bin is open to allow the documents at the lower end of said stack thereof to rest against said circular rims of said stripper idlers whereby said documents are fanned out as they are faced away from said document feeding area.

8. A document separating apparatus according to claim 1 wherein the bottom of said bin is open to allow the documents at the lower end of said stack thereof to rest against said circular rims of said stripper idlers whereby said documents are fanned out as they are faced away from said document feeding area.

9. A document separating apparatus according to claim 1 wherein each of said stripper idlers has a generally shallow cup-shaped configuration having a tubular base secured to a journal bearing mounted on said second shaft.

10. A document separating apparatus according to claim 1 wherein said stripper means comprises a stripper friction belt passing around a drive pulley mounted on said second shaft adjacent the bottom area of said stack of documents, said second shaft being driven in the opposite direction to said first shaft, said stripper idlers being rotatably mounted on said second shaft for free-wheeling rotation.

11. In a document separation means for separating sheets from a stack and assuring separation of adjacent documents comprising:

a support frame;

a resilient continuous stretchable friction belt, providing a first friction member and constituting a self-adjusting member permitting accommodation of documents of different thickness and different surface friction characteristics;

two rotatable support and path defining means on the frame for supporting said continuous stretchable friction belt;

two coaxial generally cylindrical friction drums of like diameter rotatably supported on the support frame, each having a friction surface extending around the drum and together providing a second friction member;

a non-friction belt deflection member coaxial with and between the two friction drums and of approximately the diameter of the friction drums but of smaller diameter over the surface of which non-friction member the belt is deflected from a straight path between support means into a conforming path over the non-friction drum surface to thereby supply forces acting normal to a sheet passing between the stretchable belt and the drums to generate frictional forces parallel to the sheet;

drive means on the support frame for driving the continuous stretchable belt through one of the rotatable support members in one direction and the two friction drums together in the opposite direction, such that the first and second friction members are moving in opposite direction over a sheet passing between them;

a third rotatable means freely rotatable about an axis parallel to and located between the two rotatable support means and of a size to engage and separate portions of the stretchable friction belt at diametrically opposite points;

said third rotatable means being movably supported at the area of control between the friction belt and the non-friction drum and urged toward said drum;

the improvement comprising a pair of stripper idlers mounted for free-wheeling rotation on the axis of rotation of said rotatable support for the friction belt closest to the stack of sheets, said stripper idlers having a circular rim extending around said last named axis of a size to contact the periphery of said friction drum when no document is present between said friction drum and said opposed rotating belt to cause said stripper members to rotate with the rotating friction drum under this condition, said circular rims of each of said stripper idlers being flexible away from said friction drum and having a configuration such that when a document is present between the stripper idlers and the friction drum a force is applied thereto that causes the bottom document to be fed in the desired direction through the apparatus without creating an excessive force which tends to lock the bottom document by friction to the document in contact with its upper surface.

* * * * *